United States Patent [19]

Akihiko

[11] Patent Number: 4,993,375

[45] Date of Patent: Feb. 19, 1991

[54] ENGINE CYLINDER HEAD COVER

[75] Inventor: Sobue Akihiko, Yokohama, Japan

[73] Assignee: Nissan Motor Company, Ltd., Yokohama, Japan

[21] Appl. No.: 521,965

[22] Filed: May 11, 1990

[30] Foreign Application Priority Data

Jun. 19, 1989 [JP] Japan ..... 1-156348

[51] Int. Cl.[5] ..... F01M 9/10

[52] U.S. Cl. ..... 123/90.38; 123/195 C; 123/572

[58] Field of Search ..... 123/195 C, 198 E, 572, 123/573, 90.38

[56] References Cited

U.S. PATENT DOCUMENTS

| | | | |
|---|---|---|---|
| 4,584,975 | 4/1986 | Ohmi et al. | 123/195 C |
| 4,593,659 | 6/1986 | Wells et al. | 123/195 C |
| 4,597,372 | 7/1986 | Furukawa | 123/572 |
| 4,607,604 | 8/1986 | Kanoh et al. | 123/572 |
| 4,608,950 | 9/1986 | Payne et al. | 123/195 C |
| 4,721,090 | 1/1988 | Kato | 123/572 |
| 4,760,833 | 8/1988 | Tatyrek | 123/572 |

FOREIGN PATENT DOCUMENTS

| | | | |
|---|---|---|---|
| 62-13720 | 1/1987 | Japan | 123/198 E |
| 62-131955 | 6/1987 | Japan | 123/195 C |
| 63-37464 | 10/1988 | Japan . | |

*Primary Examiner*—David A. Okonsky

[57] ABSTRACT

To scavenge blow-by gas blown into a crank case with newly introduced external air at high replacement efficiency and further to provide oil separating baffle plates at both the main oil-separation passage and the subsidiary oil separation passage (used when blow-by gas follows in the reverse direction from the external air outlet to the external air inlet), the external air outlet and the blow-by gas inlet are located in diagonally furthest positional relationship with respect to each other within the cylinder head cover; and further a U-shaped blow-by gas passage including the main oil-separation passage is arranged on one longitudinal space of the head cover and another U-shaped external air passage including the subsidiary oil-separation passage is also arranged on the other longitudinal space of the head cover.

7 Claims, 6 Drawing Sheets

(BOTTOM VIEW WITHOUT UNDER COVER)

FIG. 2 (TOP VIEW)

FIG. 3 (BOTTOM VIEW WITH UNDER COVER)

FIG. 4 (BOTTOM VIEW WITHOUT UNDER COVER)

ENGINE CYLINDER HEAD COVER

BACKGROUND OF THE INVENTION

1. Field of the Invention

The present invention relates to an engine cylinder head cover, and more specifically to a cylinder head cover for an internal combustion engine provided with blow-by gas flowing passages. Here, blow-by gas is a gas blowing into a crank case through spaces between the pistons and the cylinders during compression and explosion strokes and including non-combustion components such as HC, CO, etc., combustion components such as $CO_2$, $H_2O$, $N_2$, etc. and engine oil.

2. Description of the Prior Art

In general, the blow-by gas flowing passages for an internal combustion engine are formed to separate or remove engine oil (lubricant) from blow-by gas and further to return the blow-by gas into the intake system. In more detail, external air is introduced into the crank case from an upstream side of a throttle valve disposed in the intake passage through the cylinder head cover and scavenging holes formed in the cylinder head and the cylinder block, in order to scavenge the inner space of the crank case and the cylinder head cover, and further to return blow-by gas replaced with the external air through a blow-by gas outlet formed in the cylinder head cover to a downstream side of the throttle valve disposed in the intake passage. Further, since a fairly large amount of engine oil is included in the above-mentioned blow-by gas, in general some oil separating means are provided in the blow-by gas passage formed within the cylinder cover head, in order to prevent engine oil from being introduced into the intake passage.

An example of the above-mentioned oil separating means is disclosed in Japanese Published Unexamined (Kokai) Utility Model Appli. No. 63-37464, in which a roughly U-shaped breather chamber is formed in the cylinder head cover; blow-by gas introduced thereinto from one end of the breather chamber is turned along the U-shaped passage for oil separation; and further the turned blow-by gas is collided against a small amount of blow-by gas introduced from the other end of the breather chamber for additional oil separation. In this prior-art cylinder head cover, although a blow-by gas outlet is provided, since no external air inlet is formed, external air is directly introduced into the crank case of the internal combustion engine, and then the blow-by gas rising up through scavenging holes formed in the cylinder block and the cylinder-head is returned to the intake passage through the blow-by gas outlet.

In this prior-art structure, however, when the engine is running at high speed under heavy load, since pressure difference between the upstream side and the downstream of the throttle valve decreases, and further the amount of blow-by gas increases, there exists a problem in that blow-by gas flows through the external air passage in the reverse direction to the upstream side of the throttle valve in the intake passage, so that blown-by gas including engine oil is introduced into engine combustion chambers together with external intake air.

Therefore, where only the blow-by gas outlet and the oil separating means are provided in the cylinder head cover as in the prior-art case, without due consideration of the reversely flowing blown-by gas at high engine speed and under heavy load, it is inevitably necessary to provide an additional oil separating means at the external air inlet port on the crank case side, thus raising a problem in that the engine structure is rather complicated.

SUMMARY OF THE INVENTION

With these problems in mind, therefore, it is the primary object of the present invention to provide a cylinder head cover in which an external air inlet and a blow-by gas outlet are both formed in a small space of the cylinder head cover at two relatively ideal locations, and further two oil separating means for both the forward flowing blow-by gas and the reversely flowing blown-by gas are effectively provided in the cylinder head cover, in order to improve scavenging efficiency such that blow-by gas within the crank case can be effectively replaced with external air and to improve engine oil separation efficiency such that engine oil included in blown-by gas flowing in the reverse direction at high engine speed and heavy load can be effectively separated or removed without feeding engine oil into the intake passage.

To achieve the above-mentioned object, the engine cylinder head cover, according to the present invention, formed with a chain casing (3) and a middle longitudinal recessed portion (4) extending along a cylinder arrangement direction, comprising: (a) an external air inlet (16); (b) an external air outlet (21) formed near and on the same head cover end side as said external air inlet so as to communicate with an engine crank case; (c) an external air passage (12) formed along one side surface of the middle longitudinal recessed portion and having a first end connected to said external air inlet; (d) a subsidiary oil-separation passage (13) formed in parallel with and outside said external air passage and having a first end connected to said external air outlet, a second end of said external air passage being connected to a second end of said subsidiary oil-separation passage in U-shaped fashion; (e) a blow-by gas inlet (38) formed diagonally remote from said external air outlet so as to communicate with the engine crank case; (f) a blow-by gas outlet (30) formed on the same head cover end side as said blow-by gas inlet; (g) a blow-by gas passage (25) formed along the other side surface of the middle longitudinal recessed portion and having a first end connected to said blow-by gas outlet; and (h) a main oil-separation passage (26) formed in parallel with and outside said blow-by gas passage and having a first end connected to said blow-by gas inlet, a second end of said blow-by gas passage being connected to a second end of said main oil-separation passage in U-shaped fashion.

Further, the engine cylinder head comprises: a plurality of blow-by gas passage baffle plates (36, 37) alternately arranged in said main oil-separation passage (26) so as to extend from above and below in such a way that blow-by gas flows therethrough being moved up and down along said baffle plates to separate oil included in blow-by gas flowing from said blow-by gas inlet to said blow-by gas outlet under normal engine operating conditions, and a plurality of air passage baffle plates (19, 20) alternately arranged in said subsidiary oil-separation passage (13) so as to extend from above and below in such a way that external air flows therethrough being moved up and down along said baffle plates to separate oil included in blow-by gas reversely flowing from said external air outlet to said external air inlet when an engine is running at high speed and under heavy load.

The subsidiary oil-separation passage (3) is sloped down from a U-shaped connection end between said external air passage and said subsidiary oil-separation passage to said external air outlet (21), and the main oil-separation passage (25) is sloped up from said blow-by gas inlet (38) to a U-shaped connection end between said main oil-separation passage and said gas passage.

In the cylinder head cover according to the present invention, external air introduced from the upstream side of the intake passage through the external air inlet (16) flows through the external air passage (12) along the middle longitudinal recessed portion (4). After having been U-turned, the external air flows through the subsidiary oil-separation passage (13) to the external air outlet (21) and further into the crank case through scavenging holes formed in the cylinder head and the cylinder block, to replace blow-by gas introduced into the crank case through the spaces between the engine cylinders and the pistons with the introduced external air. The blow-by gas replaced with the external air rises upward through the scavenging holes formed in the cylinder block and the cylinder head or through the chain casing, and further flows through the blow-by gas inlet (38) to the main oil-separation passage (26). After having been U-turned, the blowing gas flows through the blow-by gas passage (25) and a transversal gas passage (29) to the blow-by gas outlet (30). The blow-by gas fed out of the blow-by gas outlet (30) is introduced into the surge tank (31a) on the downstream side of the intake system for air pollution prevention.

In the above-mentioned arrangement, since the external air outlet (21) and the blow-by gas inlet (38) are located in diagonally furthest positioned relationship with respect to each other within the cylinder head cover, it is possible to effectively prevent external gas from directly flowing into the blow-by gas inlet (38), thus improving the blow-by gas replacement efficiency.

On the other hand, when the amount of blow-by gas increases at high engine speed and under heavy load, blow-by gas flows in the reverse direction from the external air inlet (16) to the engine intake passage. In this case, however since the blow-by gas is allowed to be passed reversely through the subsidiary oil-separation passage, it is possible to effectively separate oil included in the reversely flowing blown-by gas, thus preventing engine oil from being returned into the engine intake passage.

DETAILED DESCRIPTION OF THE PREFERRED EMBODIMENTS

An embodiment of the cylinder head cover for a four series-connected DOHC (double overhead camshaft) internal combustion engine will be described hereinbelow by way of example, with reference to the attached drawings.

Figure 1:
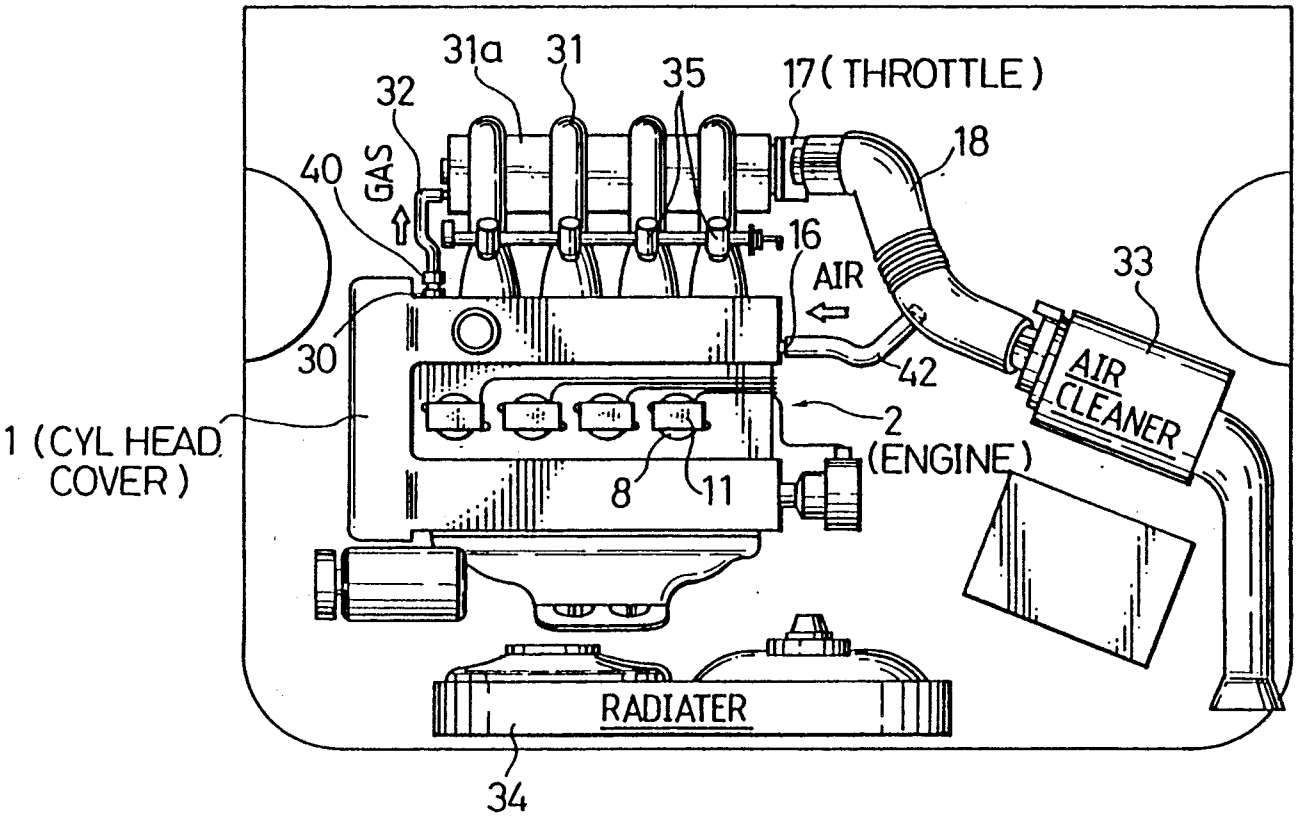
FIG. 1 is a diagrammatical illustration for assistance in explaining an exemplary element arrangement in an engine room for an automotive vehicle.

FIG. 1 shows an arrangement of essential elements in an engine room, in which an engine 2 provided with a cylinder head cover 1 is disposed a little left side from the central position in the engine room. External air is introduced into the engine 2 by way of an air cleaner 33, an intake duct 18, a throttle chamber 17, a surge tank 31*a*, and four intake manifolds 31.

Further, external air is introduced into under the engine cylinder head cover 1 from the intake duct 18 via an air tube 42 and a head cover external air inlet 16, in order to scavenge blow-by gas entering into a crank case (not shown) by displacement of the blow-by gas with external air introduced through the air tube 42. The scavenged blow-by gas is fed into the surge tank 31*a* through a blow-by gas outlet 30 and a pressure control valve (PCV) 40, in order to recycle the blow-by gas for air pollution prevention.

Further, in FIG. 1, the reference numeral 35 denotes four fuel ignition valves; 8 denotes four ignition plug holes; 11 denotes four ignition coils; and 34 denotes a radiator.

Figure 3:
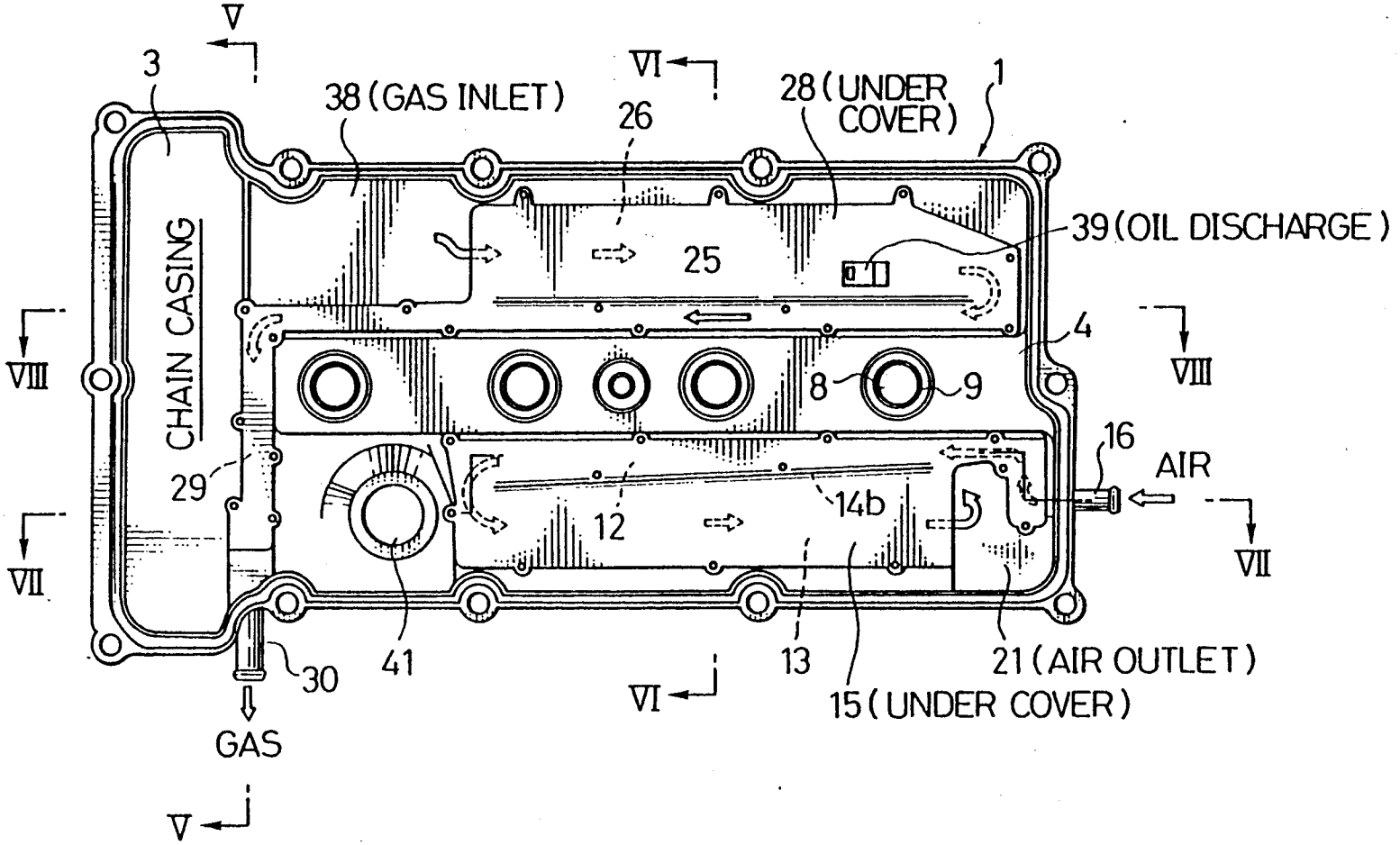
FIG. 3 is a bottom view showing the same cylinder head cover, in which two under covers are attached.

With reference to the attached drawings, in particular FIGS. 3 and 4, the route of external air introduced through the external air inlet 16 and blow-by gas fed out through the blow-by gas outlet 30 will be first described roughly hereinbelow. External air introduced from the intake duct 18 (shown in FIG. 1) to the external air inlet 16 flows through a space 5 (shown in FIG. 4) within the cylinder head cover 1 by way of an external air passage 12, baffle plates 19 and 20 after having been turned, a subsidiary oil-separation passage 13, and the external air outlet 21. The external air thus introduced is further fed into a crank case through scavenging holes formed in a cylinder head and a cylinder block (both not shown) to scavenge blow-by gas introduced into the crank case through spaces between the engine cylinders and the pistons by the introduced external air. The blow-by gas is replaced with the external air and rises upward from the crank case to the cylinder head cover 1. Thereafter, blow-by gas introduced from the crank case to the blow-by gas inlet 38 flows through a space 6 (shown in FIG. 4) within the cylinder head cover 1 by way of a main oil separation passage 26, baffle plates 36 and 37, a blow-by gas passage 25 after having been turned, a transversal blow-by gas passage 29, and a blow-by gas outlet 30.

Figure 2:
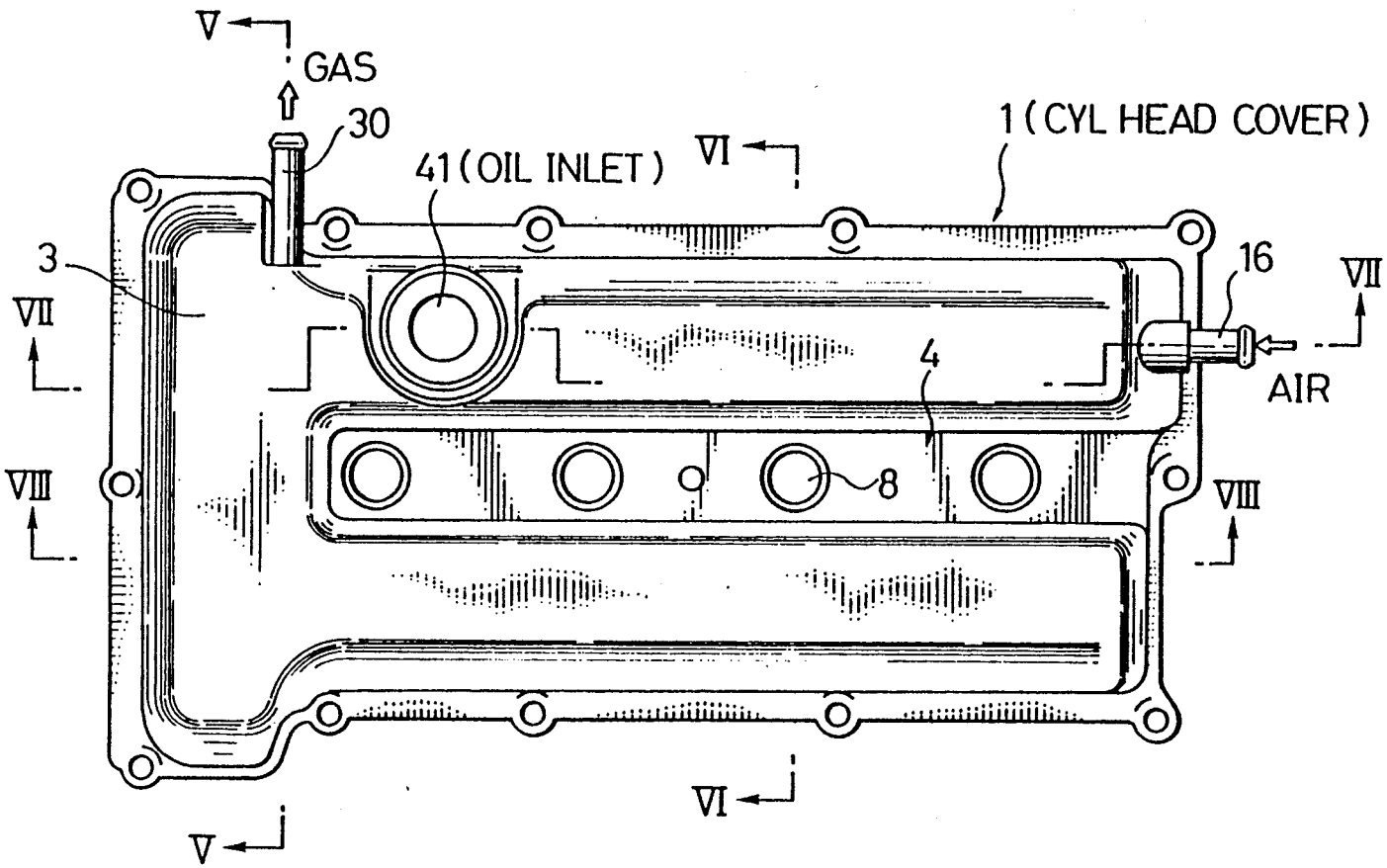
FIG. 2 is a top view showing an engine cylinder head cover according to the present invention.
Figure 4:
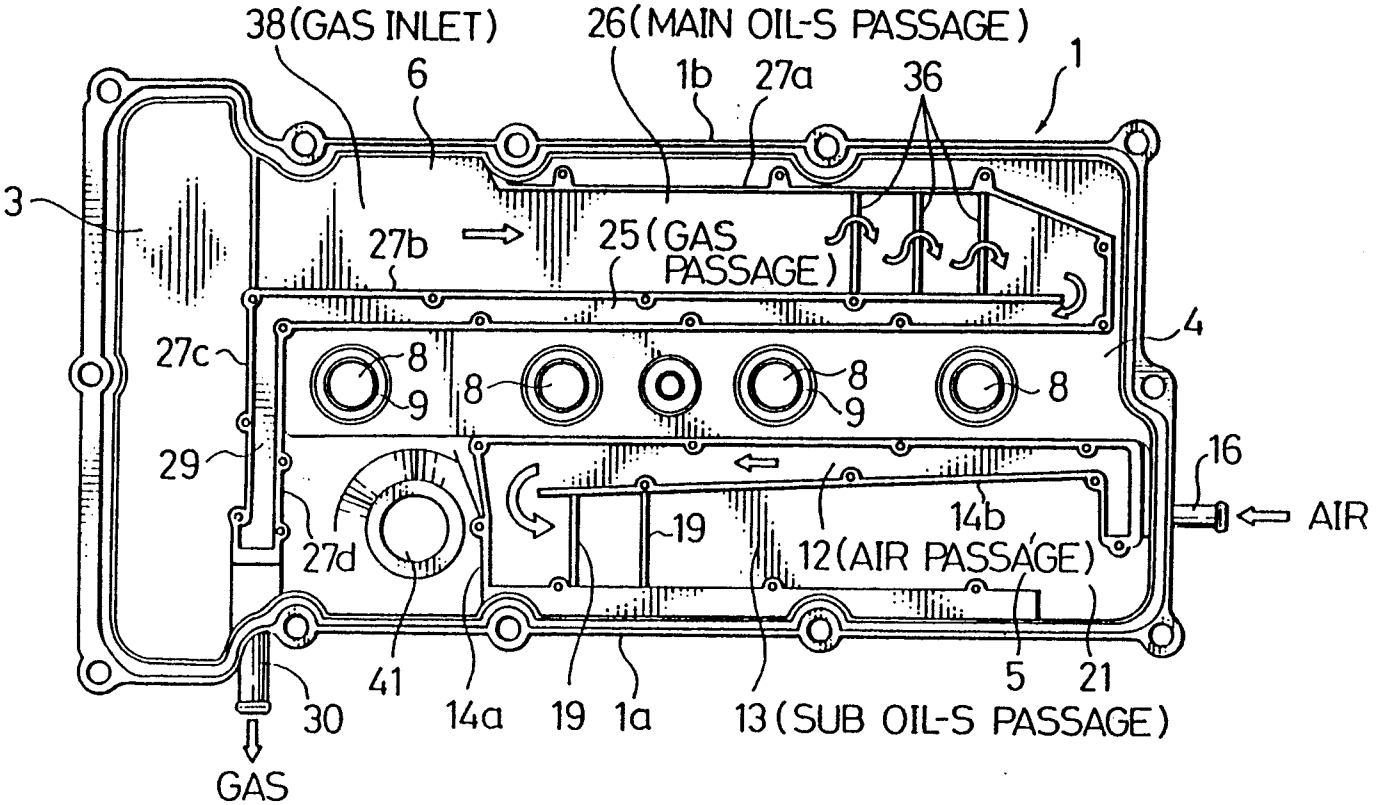
FIG. 4 is a similar bottom view showing the same cylinder head cover, in which two under covers are removed.
Figure 5:
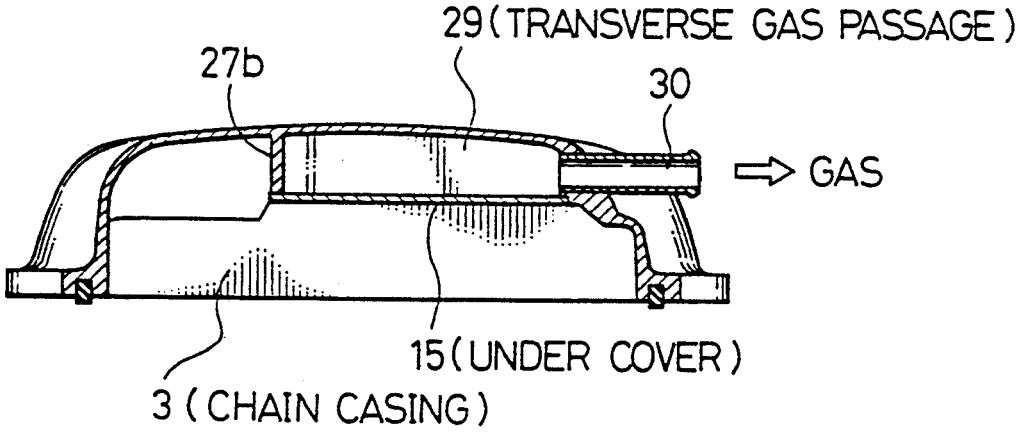
FIG. 5 is a cross-sectional view taken along the line V—V in FIGS. 2 and 3.
Figure 6:
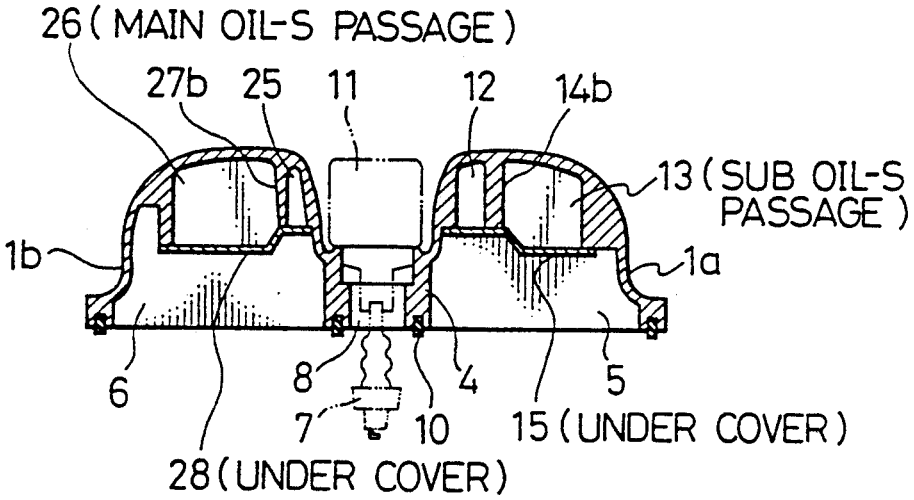
FIG. 6 is a cross-sectional view taken along the line VI—VI in FIGS. 2 and 3.

In more detail, the cylinder head cover 1 is formed into a roughly rectangular deep (reversed) dish-shape as shown in FIG. 5 and formed with a chain casing 3 for covering the upper portion of a chain chamber of a cylinder head (not shown) and a middle recessed portion 4 formed in the longitudinal direction thereof as shown in FIG. 6. The above longitudinal recessed portion 4 divides the cylinder head cover 1 into a first longitudinal space 5 for covering an intake-side camshaft and a second longitudinal space 6 for covering an exhaust-side camshaft. Further, as shown in FIG. 2, four ignition plug insertion holes 8 are formed being arranged along the longitudinal recessed portion 4 so that four ignition plugs 7 and four ignition coils 11 can be fitted from below and from above, respectively as shown in FIG. 6. Further, in FIG. 6, annular rubber sealing members 10 are disposed at the lower circumferential bottom grooves 9 (shown in FIG. 4) formed in the recessed groove portion 4.

As depicted in FIG. 4, an external air passage 12 and a subsidiary oil-separation passage 13 provided with baffle plates 19 and 20 are formed into a roughly U-shape, within a space 5 formed between one side wall la and the recessed groove portion 4, by use of a longitudinal partition wall 14*b* (shown in FIG. 4). Further, another transversal partition wall 14*a* is formed between an oil insertion hole 41 (to which an oil filler cap (not shown) is attached) and the U-shaped external air passage 12. These two partition walls 14*a* and 14*b* are die-casted integral with the cylinder head cover 1. Further, these external air passage 12 and the subsidiary oil-separation passage 13 are both covered by a metallic under cover 15, as shown in FIGS. 3, 5 and 7.

The external air passage 12 is formed along the wall surface of the recessed groove portion 4 and connected to the metallic tube external air inlet 16 on one end side thereof remote from the chain casing 3. The external air inlet 16 is connected to the intake duct 18 via the air tube 42 on the upstream side of the throttle chamber 17 in the intake passage.

Figure 7:
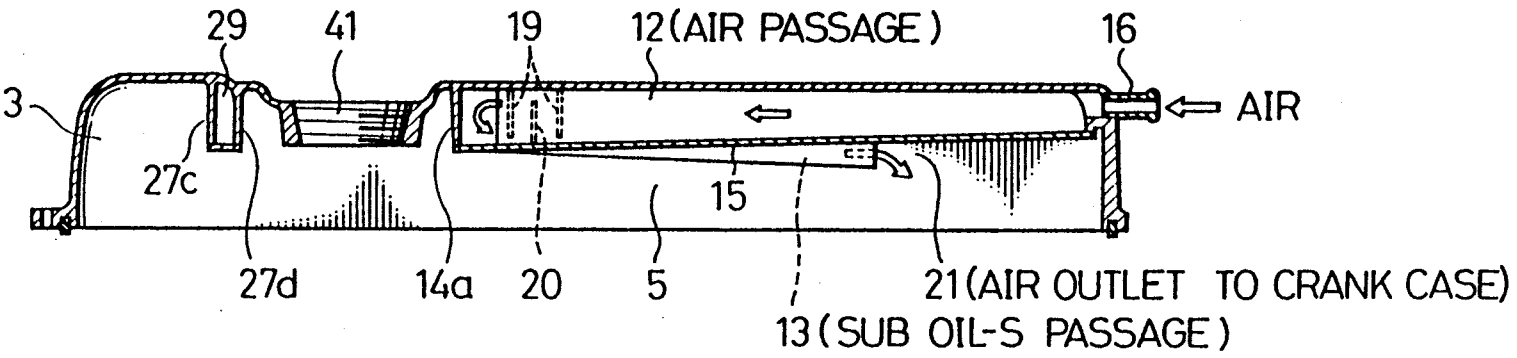
FIG. 7 is a cross-sectional view taken along the line VII—VII in FIGS. 2 and 3.

The above subsidiary oil-separation passage 13 is provided with two baffle plates 19 fixed to the cylinder head cover 1 and a single baffle plate 20 fixed to the under cover 15 as depicted in FIG. 7, in order to separate engine oil (lubricant) from blow-by gas when blow-by gas flows in the reverse direction when the engine is running at high speed and under heavy load. The end portion of the subsidiary oil-separation passage 13 is open to an external air outlet 21 (shown in FIGS. 4 and 7) which communicates with a valve chamber formed on the upper side of the cylinder head (not shown) at such a position as to be located near the external air inlet 16 of the cylinder head cover 1. Further, as shown in FIG. 7, the outer downstream side (near the side wall 1*a*) of the under cover 15 (which forms the subsidiary oil-separation passage 13) is sloped down toward the external air outlet 21 to return oil included in reversely flowing blow-by gas and separated by the baffle plates 29 and 20 into the valve chamber formed in the cylinder head (not shown).

On the other hand, as depicted in FIG. 4, a blow-by gas passage 25 and a main oil-separation passage 26 provided with baffle plates 36 and 37 are formed into a roughly U-shape, within a space 6 formed between the other side wall 1*b* and the recessed groove portion 4, by use of two longitudinal partition walls 27*a* and 27*b*. These two partition walls 27*a* and 27*b* are also die-casted integral with the cylinder head cover 1. Further, these blow-by gas passage 25 and the main oil-separation passage 26 are both covered by another metallic under cover 28, as shown in FIGS. 3 and 8.

The blow-by gas passage 25 is formed along the wall surface of the recessed groove portion 4 and connected at one end thereof to a transversal blow-by gas passage 29 formed by the two longitudinal partition walls 27*c* and 27*d* and the under cover 28 so as to extend along the chain casing 3. The transversal gas passage 29 is connected to the metallic blow-by gas outlet 30 provided on the side surface of the cylinder head cover so as to communicate with the surge tank 31*a* via the PCV valve 40 and the gas tube 32 on the downstream side of the throttle chamber 17 in the intake passage, as shown in FIG. 1.

Figure 8:
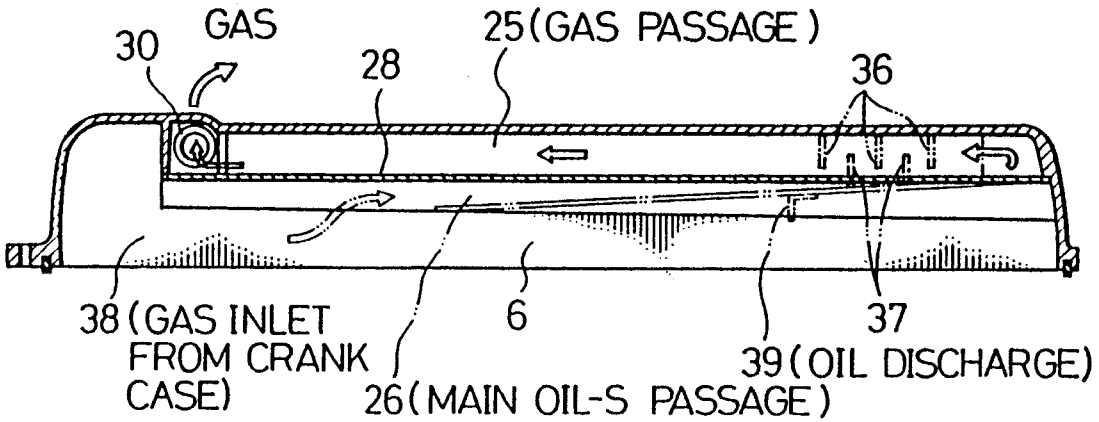
FIG. 8 is a cross-sectional view taken along the line VIII—VIII in FIGS. 2 and 3.

The above main oil-separation passage 26 is provided with three baffle plates 36 fixed to the cylinder head cover 1 and two baffle plates 37 fixed to the under cover 28 as depicted in FIG. 8, in order to separate engine oil from blow-by gas. The start portion of the main oil-separation passage 26 is open to the blow-by gas inlet 38 (shown in FIG. 4) which communicates with the valve chamber formed on the upper side of the cylinder head (not shown) at such a position as to be located roughly diagonally furthest away from the external air outlet 21 on the chain casing side of the cylinder head cover 1. Further, as shown in FIG. 8, the outer upstream side (near the side wall 1*b*) of the under cover 28 (which forms the main oil-separation passage 26) is sloped up toward the opposite side of the blow-by gas outlet 30 (or sloped down toward the blow-by gas inlet 38) to return oil included in blow-by gas and separated by the baffle plates 36 and 37 into the valve chamber via an oil discharge port 39 (shown in FIGS. 3 and 8) disposed on the upstream side of the baffle plates 36 and 37.

The function of the engine cylinder head cover according to the present invention will be described hereinbelow. When the engine is running at ordinary speed and under ordinary load, external air is introduced through the external air inlet 16, passed through the external air passage 12 so as to cool the middle longitudinal recessed portion 4, turned along the U-shaped passage through the subsidiary oil-separation passage 13, and introduced into the valve chamber through the external air outlet 21 and further into the crank case through scavenge holes (not shown) formed in the cylinder head and the cylinder block in order to scavenge the valve chamber and the crank case by the external air.

Blow-by gas replaced with the external air thus introduced are collected into under the cylinder cover head 1 through scavenge holes and the chain chamber formed on the engine side end, and introduced through the blow-by gas inlet 38 to the main oil separation passage 26. In the cylinder head cover 1 according to the present invention, since the blow-by gas inlet 38 is located diagonal with respect to or at such a position the furthest away from the external air outlet 21 (i.e. sufficiently away from the external air outlet 21), it is possible to well scavenge the inside of the engine crank case by the introduced external air. In other words, it is possible to obtain a higher scavenging efficiency and a higher replacement efficiency of the blow-by gas with the external air.

Oil included in the blow-by gas introduced into the main oil separation passage 26 is separated by the baffle plates 36 and 37 when flowing and moving up and down through the baffle plates. Further, the blow-by gas is turned along the U-shape passage and flows through the blow-by gas passage 25 and the blow-by gas transversal passage 29 to the surge tank 31*a* via the blow-by gas outlet 30.

In the above-mentioned blow-by gas passage, since the main oil separation passage 26 is sufficiently long, it is possible to well separate oil from the blown-by gas. In addition, since the blow-by gas is well cooled by the external air when passing through the main oil separation passage 26 formed near the outside of the cylinder cover head 1 and therefore the temperature of the blow-by gas is cooled low, when passing through the gas passage 25, the middle recessed portion 4 along which the ignition plug insertion holes 8 are arranged is not heated. Therefore, it is possible to keep the middle recessed portion 4 at relatively low temperature in cooperation of the cooling function of the external air flowing through the external air passage 12. Thus improving the service life of the sealing rubber ring 10. Further, oil separated from the main oil separation passage 26 is discharged through the oil discharge port 39, and only the remaining oil is returned to the valve chamber through the blow-by gas inlet 38.

On the other hand, when the engine is running at high speed and under heavy load, the amount of blow-by gas increases, so that the blow-by gas flows in the reverse direction and fed out through the external air passage 12. That is, blown-by gas is introduced from the external air outlet 21, passed through the subsidiary oil separation passage 13 in the reverse direction, and returned to the intake duct 18 on the upstream side of the throttle chamber 17 via the external air passage 12, the external air inlet 16 and the air tube 42. In this case, oil included in the reversely flowing blow-by gas introduced into the subsidiary oil separation passage 13 can be well separated by the baffle plates 19 and 20 when flowing and moving up and down through the baffle plates. In particular, since the subsidiary oil separation passage 13 is sufficiently long as that of the main oil separation passage 26, it is possible to sufficiently separate oil from the blown-by gas.

In the engine cylinder head cover of the present invention, since engine oil included in blow-by gas can be well separated before the blow-by gas is fed out through both the blow-by gas outlet 30 and the external air inlet 6 to the intake passage, it is possible to securely to prevent oil (lubricant) from entering the engine intake system, without excessively increasing the size of the cylinder head cover, because the oil separation passages 13 and 26 are both formed in U-shaped fashion within small and narrow spaces 5 and 6 partitioned by the middle longitudinal recessed portion 4 within the engine cylinder head cover.

As described above, in the engine cylinder head cover for an internal combustion engine according to the present invention, since the external air outlet and the blow-by gas inlet both open to the valve chamber are located diagonal with respect to or the furthest away from each other, it is possible to efficiently scavenge the crank case by introduced external air and therefore to improve the replacement efficiency of the blow-by gas with the introduced external air. Further, since oil included in blow-by gas can be separated before fed out through the blow-by gas outlet (at the ordinary engine speed and load) and through the external air inlet (at the high engine speed and under heavy load) by forming a sufficiently long main and subsidiary oil-separation passages, it is possible to effectively separate oil from blow-by gas.

What is claimed is:

1. An engine cylinder head cover formed with a chain casing and a middle longitudinal recessed portion extending along a cylinder arrangement direction, comprising:

(a) an external air inlet;

(b) an external air outlet formed near and on the same head cover end side as said external air inlet so as to communicate with an engine crank case;

(c) an external air passage formed along one side surface of the middle longitudinal recessed portion and having a first end connected to said external air inlet;

(d) a subsidiary oil-separation passage formed in parallel with and outside said external air passage and having a first end connected to said external air outlet, a second end of said external air passage being connected to a second end of said subsidiary oil-separation passage in U-shaped fashion;

(e) a blow-by gas inlet formed diagonally remote from said external air outlet so as to communicate with the engine crank case;

(f) a blow-by gas outlet formed on the same head cover end side as said blow-by gas inlet;

(g) a blow-by gas passage formed along the other side surface of the middle longitudinal recessed portion and having a first end connected to said blow-by gas outlet; and (h) a main oil-separation passage formed in parallel with and outside said blow-by gas passage and having a first end connected to said blow-by gas inlet, a second end of said blow-by gas passage being connected to a second end of said main oil-separation passage in U-shaped fashion.

2. The engine cylinder head cover of claim 1, which further comprises: a plurality of blow-by gas passage baffle plates alternately arranged in said main oil-separation passage so as to extend from above and below in such a way that blow-by gas flows therethrough being moved up and down along said baffle plates to separate oil included in blow-by gas flowing from said blow-by gas inlet to said blow-by gas outlet under normal engine operating conditions.

3. The engine cylinder head cover of claim 1, which further comprises: a plurality of air passage baffle plates alternately arranged in said subsidiary oil-separation passage so as to extend from above and below in such a way that external air flows therethrough being moved up and down along said baffle plates to separate oil included in blow-by gas reversely flowing from said external air outlet to said external air inlet when an engine is running at high speed and under heavy load.

4. The engine cylinder head cover of claim 1, wherein said subsidiary oil-separation passage is sloped down from a U-shaped connection end between said external air passage and said subsidiary oil-separation passage to said external air outlet.

5. The engine cylinder head cover of claim 1, wherein said main oil-separation passage is sloped up from said blow-by gas inlet to a U-shaped connection end between said main oil-separation passage and said gas passage.

6. The engine cylinder head cover of claim 1, which further comprises an oil discharge part formed in said main oil-separation passage.

7. The engine cylinder head cover of claim 1, which further comprises a transversal blow-by gas passage (29) connected between said blow-by gas passage and said blow-by gas outlet.

* * * * *